US007934461B2

(12) United States Patent
Tajima

(10) Patent No.: US 7,934,461 B2
(45) Date of Patent: May 3, 2011

(54) SEWING MACHINE CAPABLE OF SEWING SEQUINS AND METHOD FOR SETTING SEQUIN FEED AMOUNT THEREFOR

(75) Inventor: Ryo Tajima, Nagoya (JP)

(73) Assignee: Tokai Kogyo Mishin Kabushiki Kaisha (JP)

( * ) Notice: Subject to any disclaimer, the term of this patent is extended or adjusted under 35 U.S.C. 154(b) by 1189 days.

(21) Appl. No.: 11/564,421

(22) Filed: Nov. 29, 2006

(65) Prior Publication Data

US 2007/0119357 A1 May 31, 2007

(30) Foreign Application Priority Data

Nov. 30, 2005 (JP) ..... 2005-346788

(51) Int. Cl.
*D05B 3/12* (2006.01)
*G06F 7/00* (2006.01)

(52) U.S. Cl. ..... 112/475.01; 112/475.08; 112/99; 112/113; 700/136

(58) Field of Classification Search ..... 112/83, 112/88, 98, 99, 104, 113, 404, 439, 258, 112/259, 475.08, 475.01, 475.17, 475.18; 223/44, 46, 48; 428/66.5; 700/138
See application file for complete search history.

(56) References Cited

U.S. PATENT DOCUMENTS

| | | | | |
|---|---|---|---|---|
| 3,390,650 | A * | 7/1968 | Ochsner | 112/88 |
| 3,884,165 | A * | 5/1975 | Tajima | 112/83 |
| 4,807,546 | A * | 2/1989 | Lenson et al. | 112/88 |
| 4,848,253 | A * | 7/1989 | Tajima | 112/99 |
| 5,481,993 | A * | 1/1996 | Kurihara | 112/475.01 |
| 5,755,168 | A | 5/1998 | Gunther | |
| 7,082,884 | B2 | 8/2006 | Tajima | |
| 7,293,512 | B2 * | 11/2007 | Tajima et al. | 112/106 |

FOREIGN PATENT DOCUMENTS

| | | | |
|---|---|---|---|
| DE | G9209764.2 | A | 10/1992 |
| DE | 19538084 | A1 | 4/1997 |
| EP | 1568810 | A | 8/2005 |
| JP | 2004-167097 | A | 6/2004 |
| JP | 2005-205152 | A | 8/2005 |

* cited by examiner

*Primary Examiner* — Ismael Izaguirre
(74) *Attorney, Agent, or Firm* — Rossi, Kimms & McDowell LLP

(57) ABSTRACT

Sewing machine includes a plurality of machine heads, and at least one sequin feeder apparatus provided for each of the machine heads. The sequin feeder apparatus of a desired number of machine heads of the plurality of machine heads are grouped into a group, and a sequin feed pitch is variably set independently for each of the grouped sequin feeder apparatus in that group. Such an arrangement allows sequins of different sizes (different feed pitches) to be set on all of the sequin feeder apparatus in the group. If the plurality of machine heads are controlled on a group-by-group basis in order to sew a sequin-contained embroidery pattern, it is possible to increase the variety of sizes of sequins that can be used in the embroidery pattern.

7 Claims, 8 Drawing Sheets

SEWING MACHINE CAPABLE OF SEWING SEQUINS AND METHOD FOR SETTING SEQUIN FEED AMOUNT THEREFOR

BACKGROUND OF THE INVENTION

The present invention relates generally to sewing machines capable of sewing sequins. More particularly, the present invention relates to a multi-head sewing machine equipped with a plurality of machine heads and capable of variably setting a sequin feed amount individually for each of the machine heads, as well as a method for setting a sequin feed amount for the sewing machine.

Example of the conventional sequin feeder apparatus is known from German Utility Model Registration No. G9209764.2, U.S. Pat. No. 5,755,168 or German Patent No. DE19538084 (corresponding to U.S. Pat. No. 5,755,168 above). Such a known sequin feeder apparatus includes a feed mechanism, which causes a strip of a multiplicity of continuously-connected sequins (or spangles) to be played out or let out from a reel, having the continuous sequin strip wound thereon, onto a supporting plate and then, through predetermined forward and rearward (i.e., advancing and retracting) movement of a feed lever, feeds the continuous sequin strip at a predetermined pitch corresponding to the size of each sequin of the strip. One sequin is sewn at a time onto a sewing workpiece while being severed from the continuous sequin strip having been fed in interlocked relation to a sewing operation by a needle bar of the sewing machine.

Further, in Japanese Patent Application Laid-open Publication No. 2004-167097 (corresponding to U.S. Pat. No. 7,082,884), there is disclosed an embroidery sewing machine which can sew a sequin onto an embroidering workpiece, such as an embroidering fabric, by mounting or attaching a sequin feeder apparatus to a machine head. So-called multi-needle head is known, which includes a needle bar case having a plurality of needle bars corresponding to various color threads and arranged to selectively position any desired one of the color threads at a predetermined needle drop location. In some cases, two sequin feeder apparatus are attached to the opposite sides of such a multi-needle head (as seen in (A) of FIG. 1), while, in other cases, one sequin feeder apparatus is attached to only one of the opposite sides of a multi-needle head (as seen in (B) or (C) of FIG. 1).

Generally, such a sequin feeder apparatus attached to a predetermined position of a needle bar case includes a cutter mechanism for severing a sequin from a continuous sequin strip, and the cutter mechanism is driven in interlocked relation to vertical (up-and-down) movement of a needle bar retained by the needle bar case. In a case where sequin feeder apparatus 2 and 3 are attached to the opposite sides of the needle base case as shown in (A) of FIG. 1, and if the plurality of needle bars arranged in a horizontal array in the needle base case of a single machine head H1 are referred to as first, second, third, . . . , and last needles in a right-to-left direction as viewed from the front, the first and last needles are used exclusively for sewing of sequins. But, in a case where the sequin feeder apparatus is attached to only the left side of the needle base case as shown in (B) of FIG. 1, the last needle is used exclusively for sewing of sequins, and in a case where the sequin feeder apparatus is attached to only the right side of the needle base case as shown in (C) of FIG. 1, the first needle is used exclusively for sewing of sequins. Here, "used exclusively for sewing of sequins" means that the needle bar or bars in question are used for driving the sequin cutter mechanism and for sewing a fed-out and severed sequin but not used for normal embroidery sewing.

Further, in the sequin feeder apparatus, a continuous-sequin-strip feed amount (or sequin feed amount) is adjustable in accordance with a pitch between the adjoining sequins of the strip, and such a feed amount (i.e., sequin feed pitch) can be set, on an operation panel of the embroidery sewing machine, individually or independently for each of left- and right-side sequin feeder apparatus. Thus, in the case where the sequin feeder apparatus are attached to the opposite sides of the machine head, the sewing machine can sew sequins of different types (different pitches) by setting sequins of different pitches (i.e., continuous sequin strips of different sizes) on the left and right sequin feeder apparatus 2 and 3, so that the sewing machine can achieve an embroidery with enhanced decorativeness.

However, it has so far been impossible to set a desired feed amount individually for each of the machine heads in the multi-head embroidery sewing machine although it has been possible to set a desired feed amount individually for each of the left and right sequin feeder apparatus. In the case of the multi-head embroidery sewing machine, every two machine heads, for example, may be grouped into a group to permit "group control" such that embroidery sewing can be performed by handling the machine heads as if every two machine heads grouped were a single machine head. For example, if every two machine heads of the embroidery sewing machine shown in (A) of FIG. 2 are grouped sequentially in the right-to-left direction as shown in (B) of FIG. 2, each of the groups G1-G5 can have an embroidery range E2, in an X (horizontal) direction, twice as great as a corresponding embroidery range E1 of a non-grouped machine head, so that one embroidery pattern can be created using two machine heads per group. Thus, assuming that each of the machine heads has nine needles, a large-size embroidery (i.e., an embroidery pattern having a dimension, in the X direction, twice as great as an ordinary embroidery pattern created by a non-grouped machine head) can be sewn with needle bar threads of a total of 18 colors.

However, in the case where the group control is performed in the aforementioned manner, the conventional technique, where a desired sequin feed amount can not be set individually for each of the machine heads, can use sequins of only two types, differing in feed pitch (size), even if the sequin feeder apparatus are attached to both of the left and right sides of each of the heads of the group. In the case where each group consists of two machine heads, for example, the group can use, at one time, sequins of only two sizes and four colors at the most because the sequins set on the feeder apparatus attached to the left and right sides of each of the heads can be of only two different sizes, although the sequins set on the left and right feeder apparatus of the head can be of four different colors.

SUMMARY OF THE INVENTION

In view of the foregoing, it is an object of the present invention to provide an improved sewing machine which is arranged to permit setting of a sequin feed amount individually for each of a plurality of machine heads to thereby significantly increase the variety of sizes of sequins that can be used in a single embroidery pattern, for example, in a case where group control is employed, as well as a method for setting a sequin feed amount for such a sewing machine.

In order to accomplish the above-mentioned object, the present invention provides an improved sewing machine, which comprises: a plurality of machine heads; at least one sequin feeder apparatus provided for each of the machine heads; a grouping section for grouping a desired number of machine heads of the plurality of machine heads into a group, in order to sew a sequin-contained embroidery pattern; a setting section for variably setting a sequin feed pitch independently for each of the sequin feeder apparatus of the machine heads grouped into the group. In the group, a selected one of the sequin feeder apparatus performs a sequin sewing operation, and the selected sequin feeder apparatus feeds out a sequin toward a needle drop location in accordance with the feed pitch set for the selected sequin feeder apparatus via the setting section.

By the provision of the grouping section for grouping, into a group, the sequin feeder apparatus of a desired number of machine heads of the plurality of machine heads and the setting section for variably setting a sequin feed pitch individually or independently for each of the sequin feeder apparatus grouped, the present invention allows sequins of different sizes (and hence different feed pitches) to be set on all of the sequin feeder apparatus in that group. Thus, with the present invention, it is possible to significantly increase the variety of sizes of sequins that can be used in a sequin-contained embroidery pattern to be formed through cooperation of the plurality of machine heads in the group. Where the group consists of two machine heads, for example, the group can use, at one time, sequins of up to four sizes and four colors because it is possible to individually set a different color and size of sequins that are to be set on each of the sequin feeder apparatus attached to the left and right sides of each of the machine heads.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which.

DETAILED DESCRIPTION OF THE INVENTION

Figure 1:
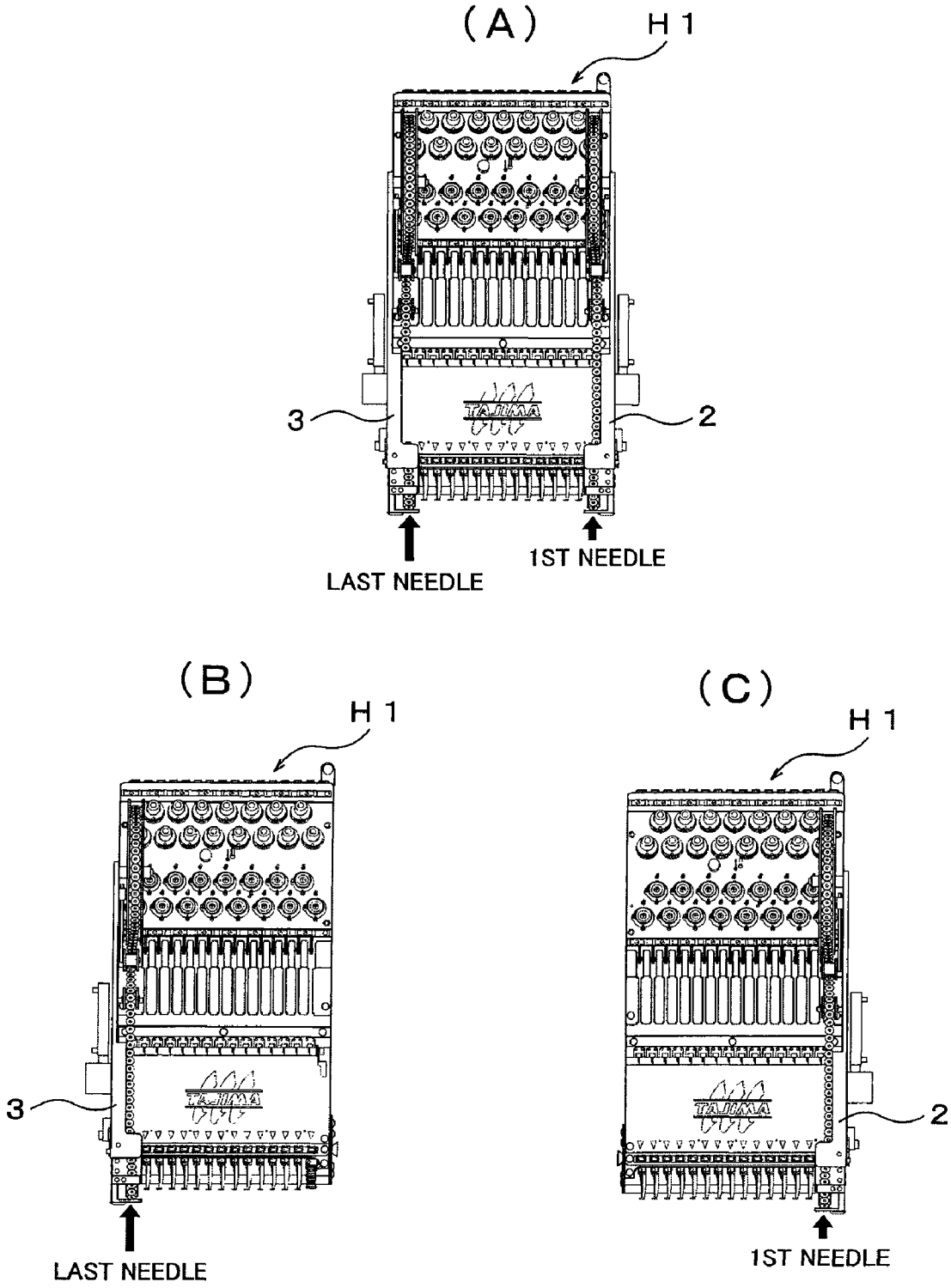
FIG. 1 is a front view showing examples of multi-needle heads having two sequin feeder apparatus attached to opposite sides of a needle bar case and having one sequin feeder apparatus attached to only one side of a needle bar case.

Mechanically, an embroidery sewing machine according to an embodiment of the present invention may be constructed in the conventionally-known manner. For example, the embroidery sewing machine according to the instant embodiment may be constructed in such a manner that a multi-needle machine head has two sequin feeder apparatus 3 and 2 attached to both of left and right sides thereof as shown in (A) of FIG. 1, or one sequin feeder apparatus 2 or 3 attached to the left or right side thereof as shown in (B) or (C) of FIG. 1. The embroidery sewing machine according to the instant embodiment is equipped with a plurality of such machine heads H, where every two (or more) adjoining machine heads are grouped into a group so that a large-size sequin-contained embroidery pattern can be sewn via the group as in the above-discussed conventional technique. Settings pertaining to the grouping can be varied as desired in the manner known in the art; however, the present invention is also applicable to a case where predetermined grouping settings are fixed. Note that any desired mechanical construction may be employed in the sequin feeder apparatus 2 and 3. For example, the sequin feeder apparatus 2 and 3 may each include: a mechanism for causing a continuous sequin strip, having a multiplicity of continuously-connected sequins, to be let out from a reel, having the continuous sequin strip wound thereon, onto the upper surface of a supporting plate and then, through predetermined forward and rearward (i.e., advancing and retracting) movement of a feed lever, feeding the continuous sequin strip at a predetermined pitch corresponding to the size of each sequin of the strip; and a mechanism for sewing a sequin at a time onto a sewing workpiece while severing the sequin from the continuous sequin strip having been fed in interlocked relation to a sewing operation by a needle bar of the sewing machine. In this case, continuous sequin strips of desired sequin colors and sizes can be set on the sequin feeder apparatus 2 and 3 in accordance with an embroidery pattern to be created. As will be later described, a "sequin feed pitch" setting process is performed in accordance with a size (and hence pitch) of sequins of a continuous sequin strip to be set.

Figure 3:
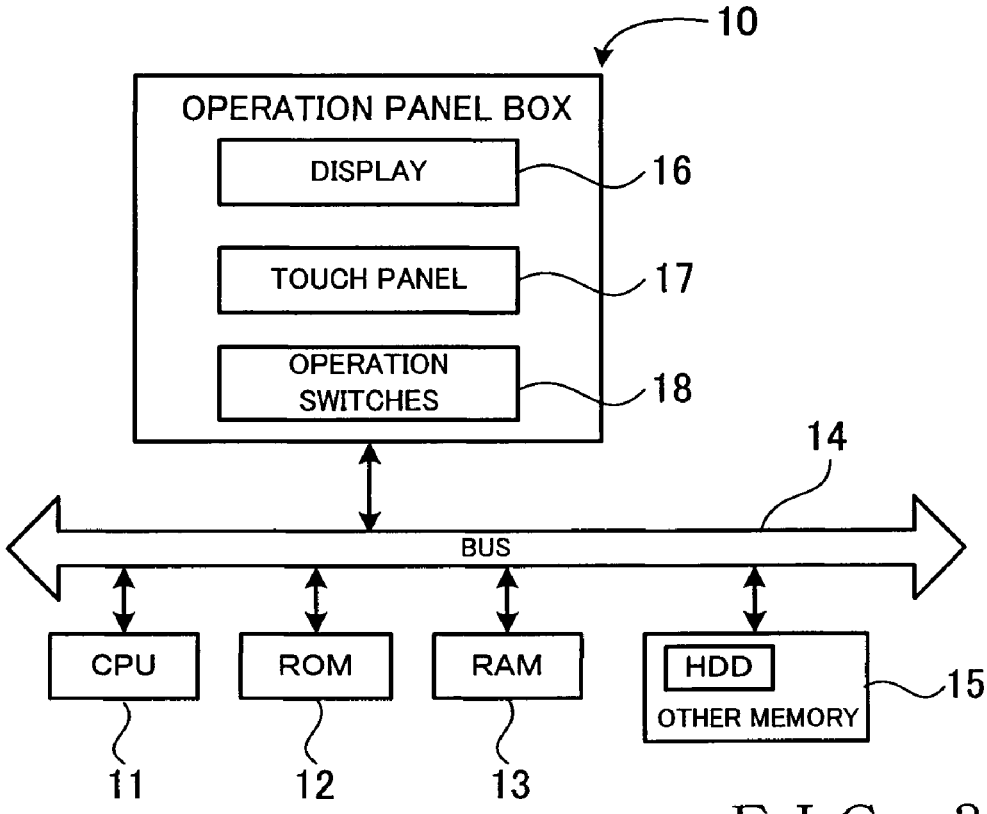
FIG. 3 is a block diagram showing a control system pertaining to an operation panel box provided in an embroidery sewing machine according to an embodiment of the present invention.

FIG. 3 is a block diagram showing a control system pertaining to an operation panel box 10 provided in the embroidery sewing machine according to the embodiment of the present invention. The control system comprises a computer including a CPU (Central Processing Unit) 11, a ROM (Read-Only Memory) 12 and a RAM (Random Access Memory) 12, and the operation panel box 10 is connected, via an interface, to a bus 14 of the computer. To the bus 14 of the computer are also connected a hard disk and/or other memory (e.g., any of a flash memory, flexible magnetic disk, CD, MO (Magneto-optical disk) and the like) as known in the art. The operation panel box 10 includes an electronic display, such as a liquid crystal display or CRT, a touch panel 17 including a group of transparent switches provided on the screen of the display 16, operation switches 18, etc. The operation panel box 10 and processing functions of the computer pertaining to the operation panel box 10 constitute means for making settings for the grouping, setting means for setting a "sequin feed pitch", and other setting means for various other setting functions.

Figure 6:
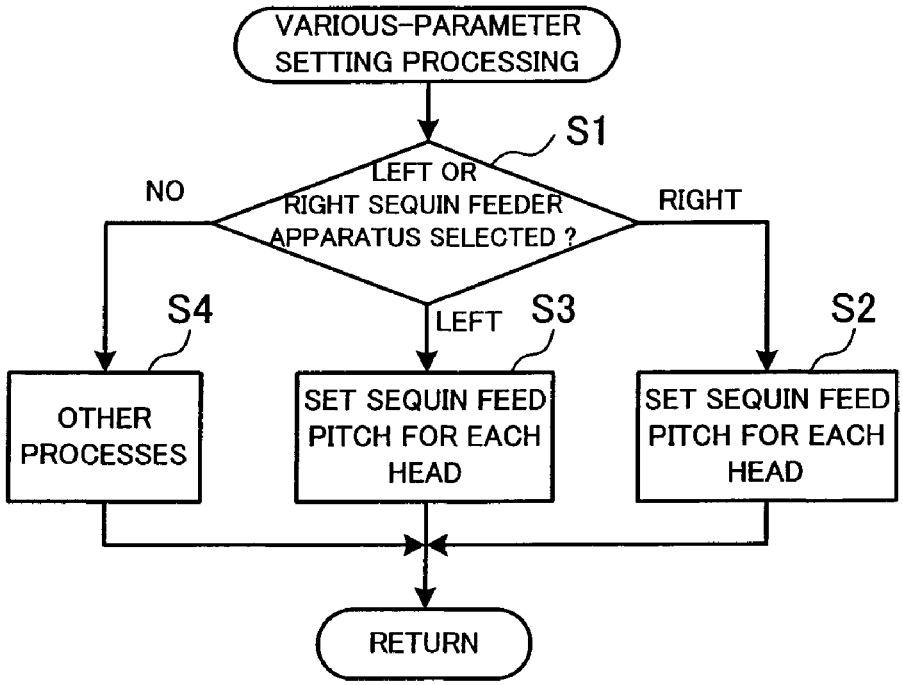
FIG. 6 is a flow chart showing an example operational sequence of a "sequin feed pitch" setting process carried out, in various-parameter setting processing, by a control system in the embroidery sewing machine according to the embodiment of the present invention.
Figure 4:
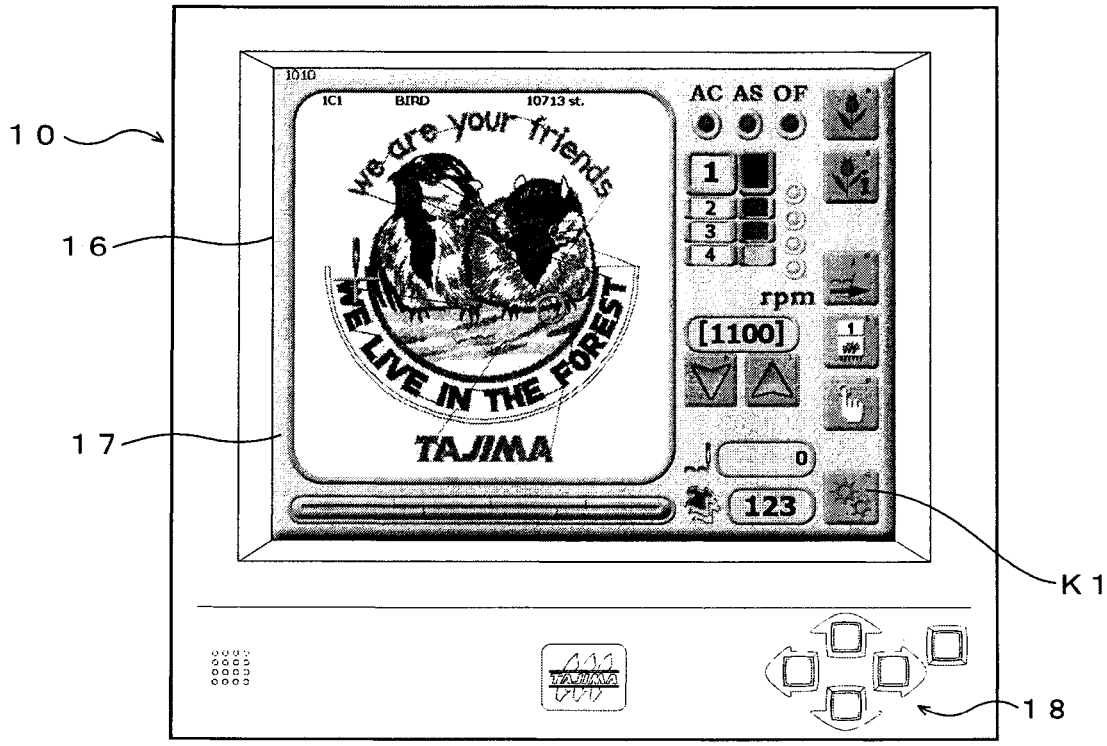
FIG. 4 is a front view showing an example of the operation panel box in the embodiment of the present invention.
Figure 5:
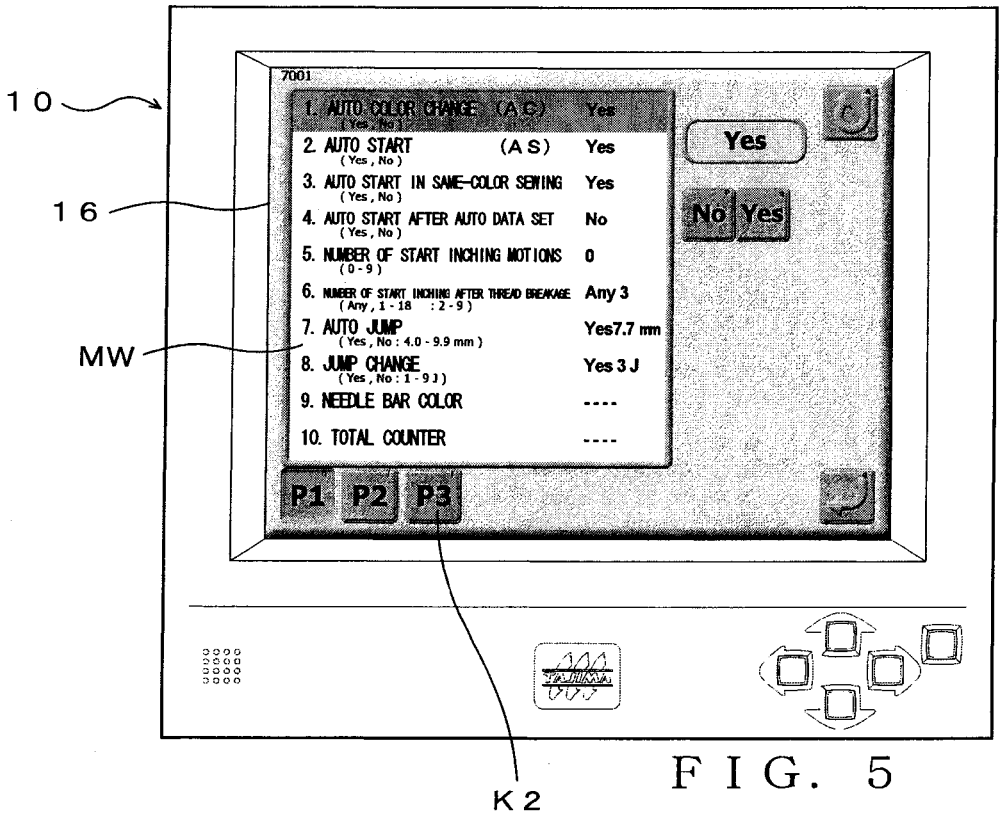
FIG. 5 is a front view of a front page screen, displayed on a display device of the operation panel box, for setting various parameters.

FIG. 4 is a front view of the operation panel box 10, which particularly shows a main screen displayed on the display 16. The touch panel 17, including the group of transparent switches, is provided on the front surface of the display 16. As known, once a human operator depresses, with his or her finger, any one of images of keys (key images) displayed on the screen of the display 16, it is determined that a key switch corresponding to the depressed key image has been turned on. Once the human operator depresses a predetermined selection key K1, the computer shifts to processing for setting various parameters (various parameter setting processing), upon which the display 16 switches to a front page screen for setting various parameters as shown in FIG. 5. On the front page screen, a menu window permits the human operator to select any one of No. 1 menu to No. 10 menu. FIG. 6 is a flow chart showing an example operational sequence of the "sequin feed pitch" setting process carried out in the various-parameter setting processing.

At step S1 of FIG. 6, a determination is made as to which of the left and right sequin feeder apparatus 3 and 2 has been selected. If the right sequin feeder apparatus 2 has been selected as determined at step S1, control goes to step S2, where a "sequin feed pitch" to be achieved by the right sequin feeder apparatus 2 is set for each of the machine heads independently of the other heads. If, on the other hand, the left sequin feeder apparatus 3 has been selected as determined at step S1, control goes to step S3, where a "sequin feed pitch" to be achieved by the left sequin feeder apparatus 3 is set for each of the machine heads independently of the other heads. If none of the left and right sequin feeder apparatus 3 and 2 has been selected, i.e. no "sequin feed pitch" is to be set here, control branches to step S4 to perform other processes as necessary.

Example of selection operation pertaining to the determination at step S1 is now explained. Once the human operator turns on a key image K2 of page "P3" twice in succession on the front page screen of FIG. 5, switching is made from the previous screen to another screen, so that a key image of page "P6" is displayed. Once the human operator depresses the key image of page "P6" on the screen, the display of the menu window MW switches to a screen on which the human operator is allowed to select any one of 51st to 59th menus (including a menu for setting sequin feed pitches for the left and right sequin feeder apparatus). On that screen, a tag image of "51. automatic fueling device" menu in the uppermost row of the menu window MW is initially displayed in a highlighted or inverted manner. If the human operator depresses a tag image of "54. sequin apparatus (R)" in the menu window MW on the screen, switching is effected to a sequin feed amount setting screen as shown in (A) of FIG. 7, where the depressed tag image in the menu window MW is displayed in an inverted manner to indicate that the current screen is a sequin feed amount setting screen for the right sequin feeder apparatus 2 (i.e., right-side feed amount). In this manner, the right sequin feeder apparatus 2 is selected, and control proceeds to step S2 of FIG. 6. If, on the other hand, the human operator has depressed a tag image of "55. sequin apparatus (L)" in the menu window MW on the screen, the depressed tag image in the menu window MW is displayed in an inverted manner to indicate that the current screen is a sequin feed amount setting screen for the left sequin feeder apparatus 3 (i.e., left-side feed amount). In this manner, the left sequin feeder apparatus 3 is selected, and control proceeds to step S3 of FIG. 6.

Now, with reference to FIG. 7, a description will be given about a sequin feed amount setting process performed at step S2 of FIG. 6. On the screen shown in (A) of FIG. 7, "Any 6.0" is displayed to the right of "54. sequin apparatus (R)" in the menu window MW, which indicates that the sequin feed amount (feeing pitch) is currently set at 6.0 mm in the right (R) sequin feeder apparatus 2 attached to all of the machine heads. Similar information is displayed in a setting confirmation image section CI in an upper right region of the menu window MW. When the setting of the sequin feed amount (i.e., feed pitch) is to be changed, the human operator enters a desired value of the sequin feed amount by operating a numeric keypad image section TK on the screen. For example, once the human operator depresses a "0" key of the numeric keypad image section TK on the screen shown in (A) of FIG. 7, switching is effected to a screen shown in (B) of FIG. 7, where "0" is displayed immediately below "Any" in the setting confirmation image section CI. Once the human operator depresses a return key image RK in order to establish the setting, switching is effected to a screen shown in (C) of FIG. 7, where the display to the right of "54. sequin apparatus (R)" in the menu window MW has changed to "Any 0". If the feed pitch for the right sequin feeder apparatus 2 has been set to "Any 0" in the aforementioned manner, the right sequin feeder apparatus 2 of each of the machine heads is set in a non-usable state so that none of the right sequin feeder apparatus 2 attached to the machine heads is activated. Of course, setting of such a non-usable state (i.e., Any 0" ") is made (or may be automatically made) for each machine head where the right sequin feeder apparatus 2 is not attached to the right or left sequin feeder apparatus 2 or 3. The same explanation given above in relation to the right sequin feeder apparatus 2 applies to the left sequin feeder apparatus 3.

Figure 2:
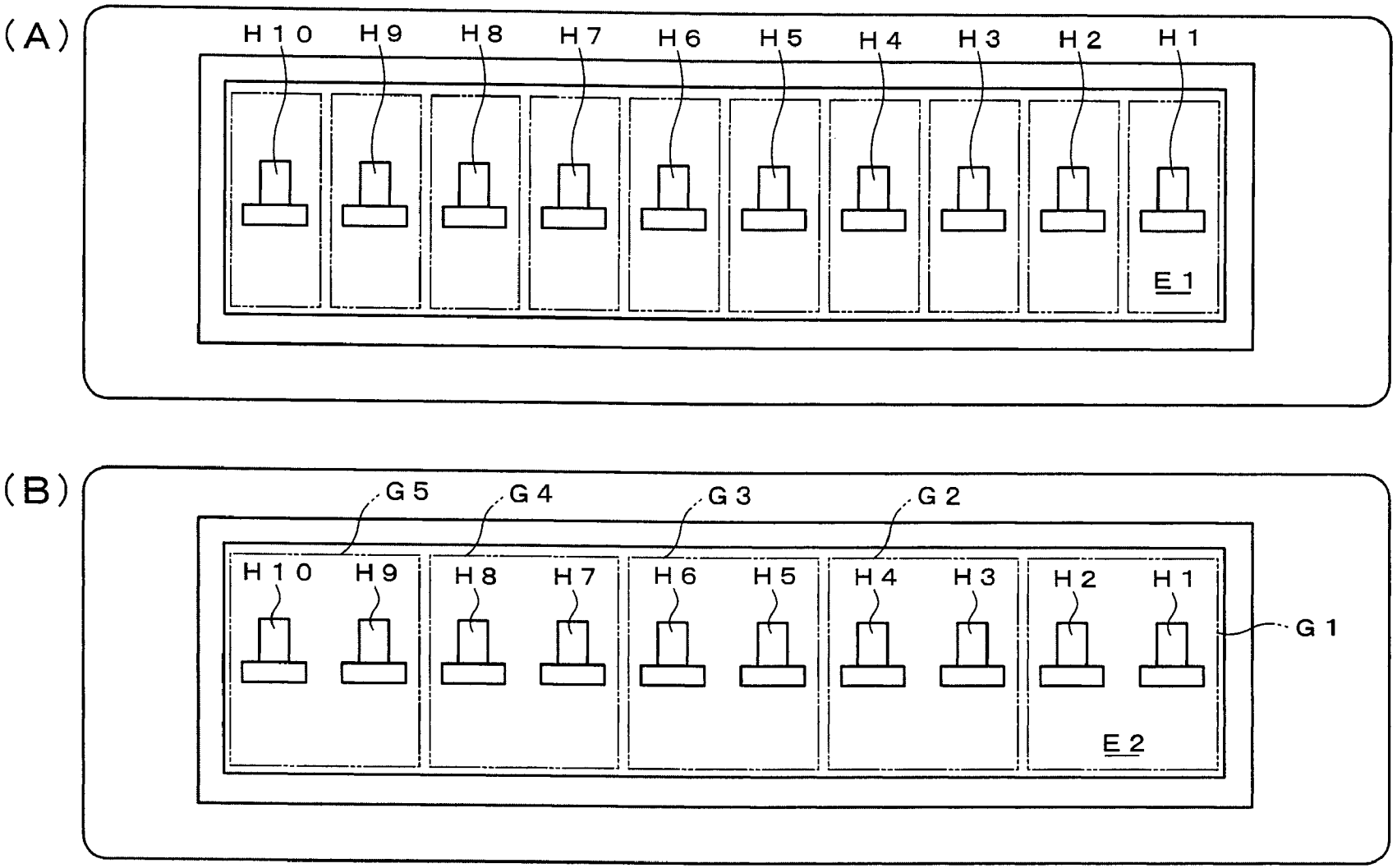
FIG. 2 is a schematic plan view explanatory of an example manner in which a plurality of machine heads are grouped in a multi-head embroidery sewing machine.
Figure 7:
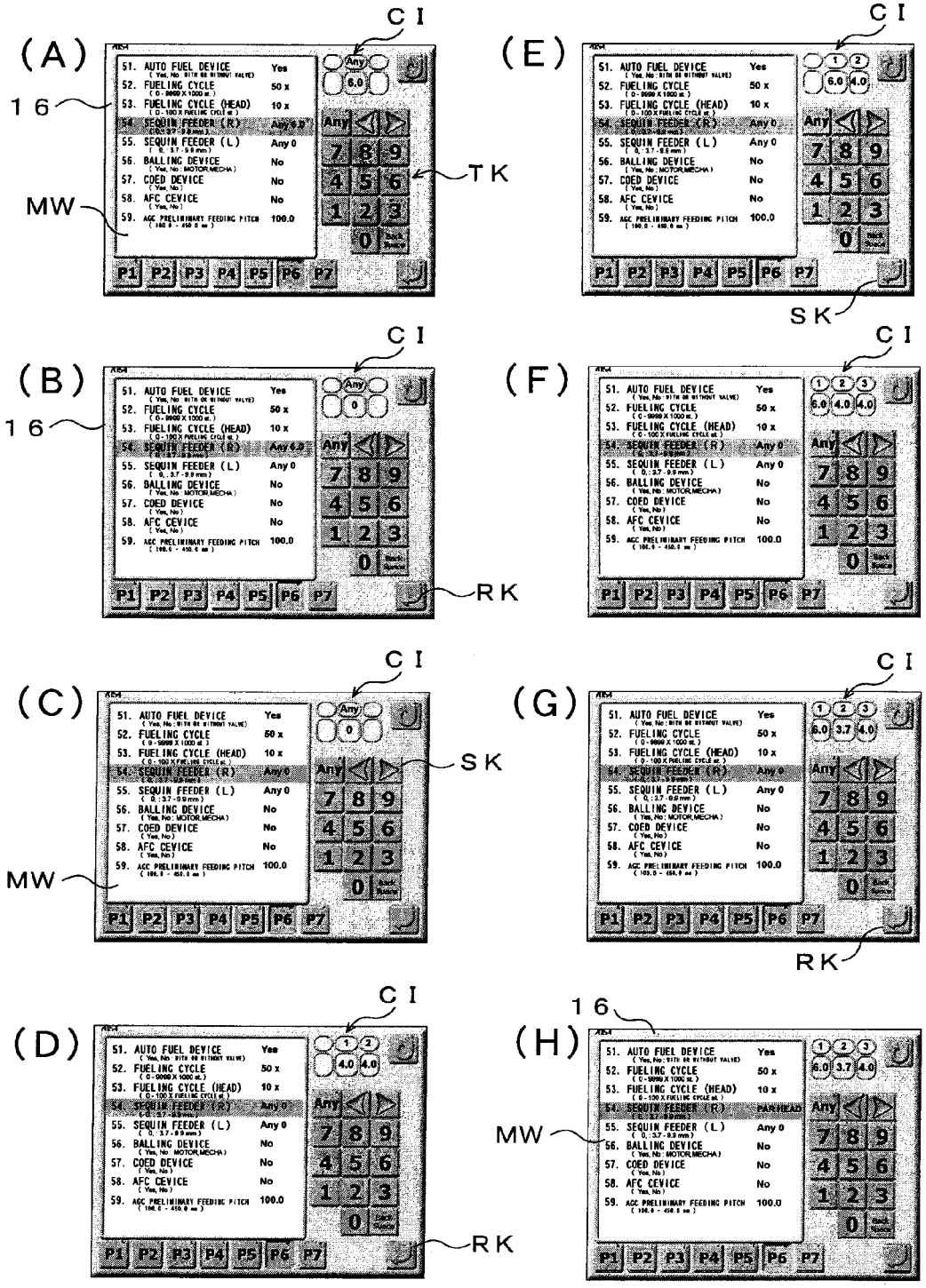
FIG. 7 is a diagram showing various display screens explanatory of a sequence of setting operation pertaining to the "sequin feed pitch" setting process of FIG. 6.

In order to activate a mode for setting a sequin feed amount (or feed pitch) individually for each of the machine heads on the screen shown in (C) of FIG. 7, a right shift key image SK is turned on. Upon turning on of the right shift key image SK, switching is effected to a screen shown in (D) of FIG. 7, where a predetermined default value "4.0" (mm) of the sequin feed pitch is displayed, in the setting confirmation image section CI, for the 1st and 2nd machine heads. Namely, in (D) of FIG. 7, "1" in an upper middle display block of the setting confirmation image section CI indicates the 1st machine head (H1 in FIG. 2), and "2" in an upper right display block of the setting confirmation image section CI indicates the 2nd machine head (H2 in FIG. 2). Let it be assumed here that, in this case, the rightmost machine head as viewed from the front of the sewing machine is assigned machine head number "1" and the other machine heads are assigned machine head numbers that increase in the right-to-left direction. Sequin feed amounts having been set for the machine heads of the numbers indicated in the upper display blocks are indicated in individual lower display blocks of the setting confirmation image section CI. The numerical value indicated in the lower middle display block of the setting confirmation image section CI can be changed by the human operator operating the numerical keypad image section TK.

In the aforementioned manner, the feed amount (i.e., feed pitch) of the right sequin feeder apparatus of the first machine head can be set or changed on the screen shown in (D) of FIG. 7. For example, when the feed amount (i.e., feed pitch) of the right sequin feeder apparatus of the first machine head is to be set to 6.0 mm, the human operator enters the numerical value "6.0" by sequentially depressing the keys of values "6" and "0" in the numerical keypad image section TK and then depresses the return key image PK to set the entry. Then, switching is effected to a screen shown in (E) of FIG. 7, where the value "6.0" is displayed in the lower middle display block of the setting confirmation image section CI. When the object of setting (i.e., the machine head for which a sequin feed amount (i.e., feed pitch) should be set) is to be switched to the 2nd machine head, the human operator turns on the right shift key image SK once. Then, switching is effected to a screen shown in (F) of FIG. 7, where the displayed information of the setting confirmation image section CI has moved leftward by one block; namely, the display of the machine number "1" and feed amount setting "6.0" has shifted to respective left-adjoining blocks. Further, on the screen shown in (F) of FIG. 7, the value "2" indicative of the 2nd machine head is displayed in the upper middle display block, and the default value "4.0" is displayed in the lower middle display block immediately beneath the upper middle display block, and the value "3" indicative of the 3rd machine head and the default value "4.0" for the 3rd machine head are newly displayed respectively in the blocks to the right of the middle display blocks.

The sequin feed amount (i.e., feed pitch) for the 2nd machine head, displayed in the lower middle display block, can be set or changed on the screen shown in (F) of FIG. 7. For example, when the sequin feed amount for the 2nd machine head is to be set to 3.7 mm, the human operator enters the numerical value "3.7" by sequentially depressing the keys of values "3" and "7" in the numeric keypad image section TK and then depresses the return key image PK to set the entry. Then, switching is effected to a screen shown in (G) of FIG. 7, where the value "3.7" is displayed in the lower middle display block of the setting confirmation image section CI.

After that, the human operator can enter desired sequin feed amounts for the remaining machine heads by turning on the right shift key image SK to sequentially update the machine head for which a desired sequin feed amount (i.e., feed pitch) should be set. When the human operator wants to revert to a given one of the machine heads to reset a sequin feed amount previously set for the given machine head, the human operator turns on a left shift key instead of turning on the right shift key. When desired feed amounts have been set for all of the machine heads in the aforementioned manner, the human operator depresses the return key image RK to establish the sequin feed amount settings. Then, switching is effected to a screen shown in (H) of FIG. 7, where the information displayed to the right of "54. sequin apparatus (R)" in the menu window MW has changed to "head by head". The displayed information "head by head" indicates that the sequin feed pitch has been set individually for each of the machine heads. The sequin feed pitch settings established for the individual machine heads are stored into a working area of the RAM 13 in a volatile manner or into a memory 15 in a non-volatile manner. When the sequin feed pitch settings established for the individual machine heads are to be checked on the screen shown in (H) of FIG. 7, it is only necessary for the human operator to turn on the right shift key SK or left shift key image to sequentially shift rightward or leftward the display of the setting confirmation image section CI.

Sequin feed pitch setting process for the left sequin feeder apparatus 3 is performed at step S3 of FIG. 6 in the same manner as the sequin feed pitch setting operation for the right sequin feeder apparatus 2 having been described above with reference to FIG. 7. Namely, once the human operator depresses the tag image of "55. sequin apparatus (L)" in the menu window MW, the depressed tag image is displayed in an inverted manner to place the sequin feed amount setting screen for the left sequin feeder apparatus in the selected state. Then, the human operator is allowed to perform operation for setting a desired sequin feed amount (i.e., feed pitch) for the left sequin feeder apparatus (i.e., left-side feed amount) using the numeric keypad image section TK, return key image RK, right shift key image SK, setting confirmation image section CI, etc. in the same manner as described above with reference to FIG. 7.

The instant embodiment of the present invention is constructed to set a sequin feed amount individually for each of the machine heads, as described above. When group control as mentioned above is to be performed on the embroidery sewing machine, the instant embodiment, which is constructed to allow a desired sequin feed pitch (i.e., feed amount) to be set individually for each of the machine heads, can variably set a desired sequin feed pitch individually for each of a desired plurality of the sequin feeder apparatus attached to the machine heads that are to be handled as a group. For example, if, in the embroidery sewing machine equipped with ten machine heads H1-H10 as illustrated in (A) of FIG. 2, every two machine heads are sequentially grouped in the right-to-left direction as shown in (B) of FIG. 2, each of the groups G1-G5 can have an embroidery range E2, in the X direction (i.e., horizontal left-right direction), twice as great as an embroidery range E1 of a non-grouped machine head, so that one embroidery pattern can be created using two machine heads per group. Thus, assuming that each of the machine heads has nine needles, a large-size embroidery (i.e., an embroidery pattern having a dimension, in the X direction, twice as great as an ordinary embroidery pattern created by a non-grouped machine head) can be sewn with needle bar threads of a total of 18 colors. In addition, because the instant embodiment of the present invention allows sequins of a different size (and hence different feed pitch) to be set on each of the sequin feeder apparatus in the group, it can increase the variety of sizes of sequins that are usable in a single sequin-contained embroidery pattern created by cooperation of the machine heads in the group. For example, in the case where each group consists of two machine heads, the group can use, at one time, sequins of up to four sizes and four colors because it is possible to set a desired color and size of sequins to be set on each of the sequin feeder apparatus attached to the left and right sides of each of the machine heads. Note that the number of adjoining machine heads to be grouped into a group may be any desired plural number other than two, such as three or four. Thus, in the case where the group consists of three machine heads, the group can use, at one time, sequins of up to six sizes and six colors to form a large-size embroidery (i.e., an embroidery pattern having a dimension, in the X direction, three times as great as an ordinary embroidery pattern to be sewn by a non-grouped machine head). Further, in the case where each of the groups consists of four machine heads, the group can use, at one time, sequins of up to eight sizes and eight colors to form a large-size embroidery (i.e., an embroidery pattern having a dimension, in the X direction, four times as great as an ordinary embroidery pattern to be sewn by a non-grouped machine head). In an alternative, sequins of a different size may be used in each of the machine heads with all of the machine heads of the sewing machine handled as a single group.

Note that the present invention is not necessarily limited to the arrangements for setting a sequin feed pitch individually for each and every one of machine heads in an embroidery sewing machine as in the above-described embodiment; in short, it is only necessary that arrangements be made in the present invention for setting a sequin feed pitch individually for each of machine heads belonging to a single group in an embroidery sewing machine. Let it be assumed here that, in such a case, the same sequin feed pitches set for the individual machine heads belonging to a given group are shared among all of the groups; that is, the settings of the sequin feed pitches established for the individual machine heads belonging to the given group are applied to the corresponding machine heads of the other groups. For example, in a case where every two machine heads are sequentially grouped in the right-to-left direction as shown in (B) of FIG. 2, a desired sequin feed is set independently for each of the left and right sequin feeder apparatus in the first and second machine heads from the right of a given group, and then the thus-set sequin feed pitches may be used for the corresponding (i.e., first and second) machine heads of all of the groups. The same explanation applies to a case where every three machine heads are sequentially grouped; namely, in this case, a sequin feed pitch is set independently for each of the left and right sequin feeder apparatus in the first, second and third machine heads from the right of a given group, and then the thus-set sequin feed pitches are used for the corresponding (i.e., first, second and third) machine heads of all of the groups. Note that, in the present invention, the way of grouping the machine heads, such as the number of the machine heads per group, can be variably set as desired using the operation panel box 10. The way of grouping the machine heads is known in the art and will not be described here. Because the machine heads can be grouped so that each group consists of any desired number of the machine heads, the number n of the machine heads per group does not necessarily equal a divisor of the total number m of the machine heads in the embroidery sewing machine, which is however quite permissible. If, for example, each group is composed of three machine heads in the multi-head embroidery sewing machine with ten machine heads shown in (B) of FIG. 2, there are formed three groups, each consisting of three machine heads, with one machine head ungrouped; in this case, the ungrouped machine head may be kept in a rest or non-operating state. In the case of a multi-head embroidery sewing machine with twelve machine heads, there are provided four groups, each consisting of three machine heads, with no machine head ungrouped. Anyway, according to the present invention, the way of grouping the machine heads may be determined as desired.

Generally, when sequins are to be sewn by an embroidery sewing machine, it is sometimes preferable that the embroidery sewing machine be operated more slowly with a smaller number of rotations of a main machine shaft (hereinafter also referred to as "machine rotations") per predetermined unit time (i.e., lower ascending/descending speed of the needle bars) than that in normal embroidery sewing. Thus, in a case where an embroidery pattern is to be sewn through a mixture of normal color-thread embroidery sewing and sequin sewing with the normal color-thread embroidery sewing performed at a speed of, for example, 1,200 rpm and the sequin sewing performed at a lower speed of, for example, 1,000 rpm, and when a shift is to be made to the sequin sewing during the embroidery pattern sewing, it was necessary in the past to take the trouble of temporarily stopping the operation of the embroidery sewing machine to change the setting of the number of rotations of the main machine shaft (i.e., machine rotations). To eliminate the need for the trouble, the instant embodiment of the present invention is arranged to allow a desired number of machine rotations to be set in advance for the sequin sewing, as set forth hereinbelow.

Figure 8:
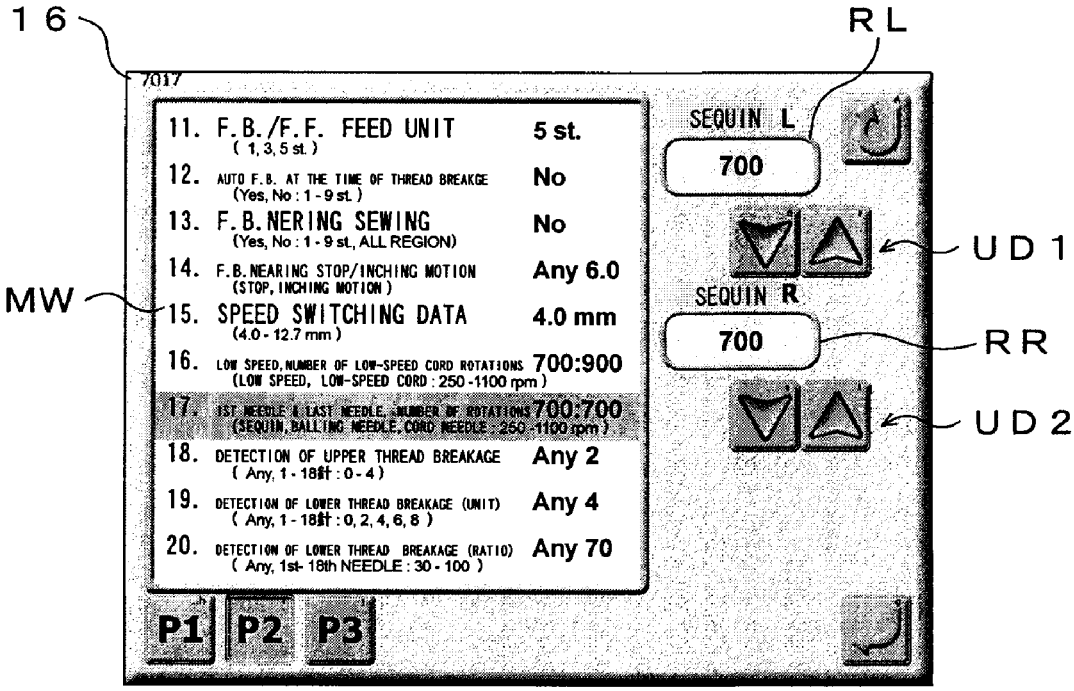
FIG. 8 is a diagram showing a display screen explanatory of a sequence of setting operation pertaining to a process for setting a desired number of machine rotations for sequin sewing.

Once the human operator depresses the key image of page "P2" on the front page screen shown in FIG. 5, the display of the menu window MW switches to a screen on which the human operator is allowed to select any one of 11th to 20th menus (including a menu for setting a desired number of machine rotations for the sequin sewing). On that screen, a tag image of the 11th menu in the uppermost row of the menu window MW is initially displayed in a highlighted or inverted manner. If the human operator depresses a tag image of "17. numbers of rotations, first and last needles" in the menu window MW on the screen, switching is effected to a screen for setting numbers of machine rotations for sequin sewing as shown in FIG. 8, where the depressed tag image in the menu window MW is displayed in an inverted manner to indicate that the current screen is a screen for setting numbers of machine rotations for the sequin sewing. In FIG. 8, the number of machine rotations having been set for the first needle (leftmost needle bar in the needle bar case of each machine head) corresponding to the right sequin feeder apparatus 2 of the machine head is displayed in a number-of-rotation display block RR for "sequins R" located to the right of the menu window MW, while the number of machine rotations having been set for the last needle (e.g., ninth needle bar in the needle bar case of each machine head in the case where the needle bar case has nine needle bars) corresponding to the left sequin feeder apparatus of the machine head is displayed in a number-of-rotation display block RL for "sequins L" located to the right of the menu window MW. In an initial state, a predetermined default value, which may be either a predetermined default number-of-rotation value for sequins or a currently-set normal number-of-rotation value, is displayed in the number-of-rotation display blocks RR and RL. The number of machine rotations displayed in the number-of-rotation display block RL for sequins L can be increased or decreased by the human operator manipulating an up/down key image section UD1 for sequins L, so that a desired number of machine rotations can be set for the left sequin feeder apparatus 3 of each machine head. Similarly, the number of machine rotations displayed in the number-of-rotation display block RR for sequins R can be increased or decreased by the human operator manipulating an up/down key image section UD2 for sequins R, so that a desired number of machine rotations can be set for the right sequin feeder apparatus 2 of each machine head. Such a process for setting the numbers of machine rotations is carried out, for example, at step S4 of FIG. 6.

As an operational sequence for sewing an embroidery pattern progresses during embroidery sewing operation by the machine, it enters a sequin sewing step. At the sequin sewing step, the first needle (of the right sequin feeder apparatus 2) or the last needle (of the left sequin feeder apparatus 3) is selected and switching is made from the so-far activated needle bar of an ordinary color thread over to the selected first or last needle, so that the number of machine rotations is automatically switched to that having been set for the right or left sequin sewing in the aforementioned manner; thus, switching is automatically effected to the sequin sewing without the operation of the sewing machine being stopped. In this way, the instant embodiment of the invention can eliminate the need for the trouble of temporarily stopping the operation of the embroidery sewing machine to change the setting of the number of machine rotations at the time of switching to the sequin sewing, thereby achieving a significantly enhanced embroidering efficiency as compared to the conventional counterpart. Of course, when switching is to be made from the sequin sewing back to the normal sewing too, the instant embodiment can eliminate a need for the human operator to manually restore the number of machine rotations for the normal sewing, by automatically switching the number of machine rotations.

Figure 9:
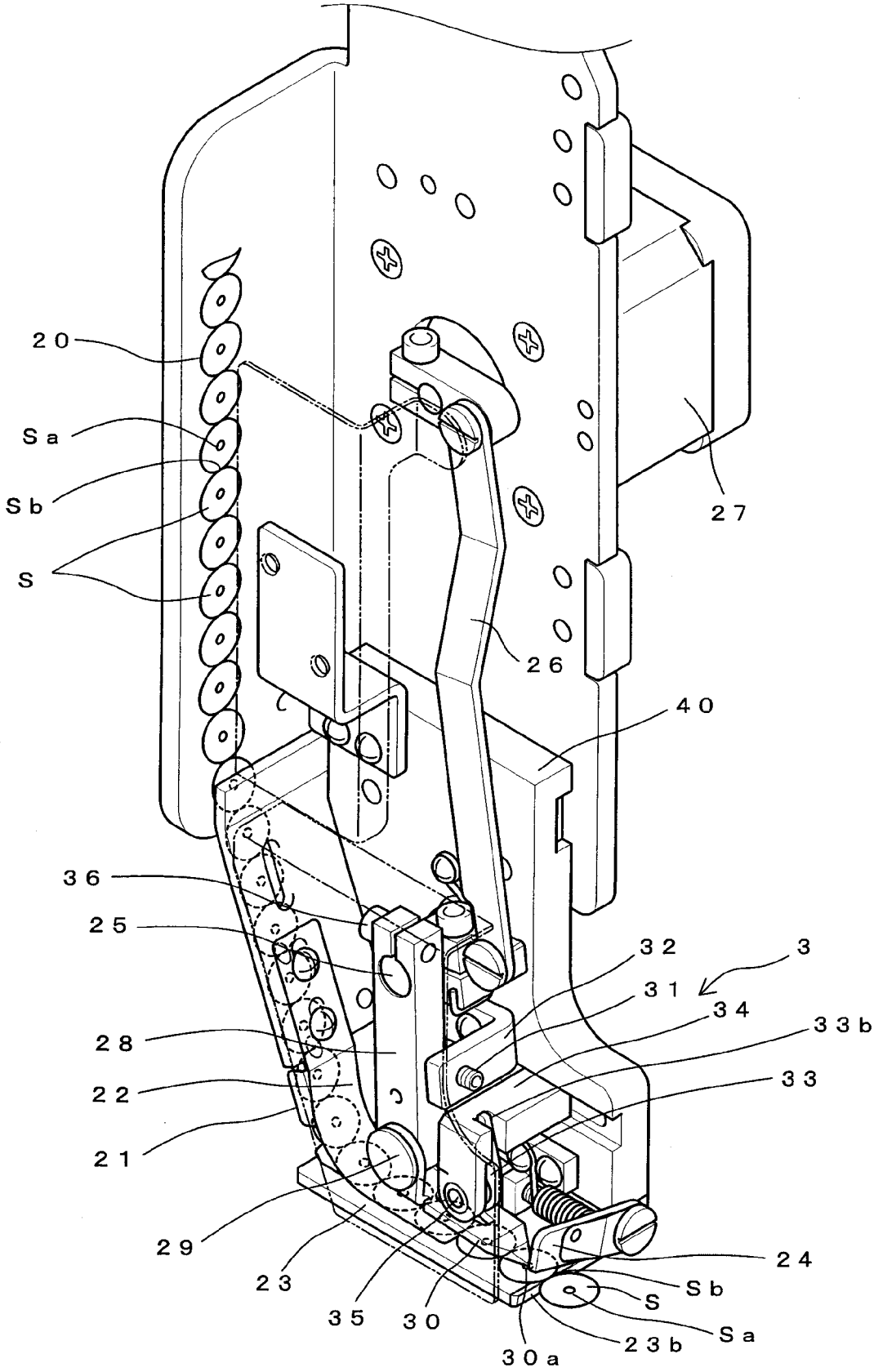
FIG. 9 is a perspective view showing an example of a sequin feeder apparatus; and (A) of FIG. 10 is a partly-sectional side view showing in enlarged scale of relevant sections of the sequin feeder apparatus, and (B) of FIG. 10 is a schematic plan view of the relevant sections of the sequin feeder apparatus.
Figure 10:
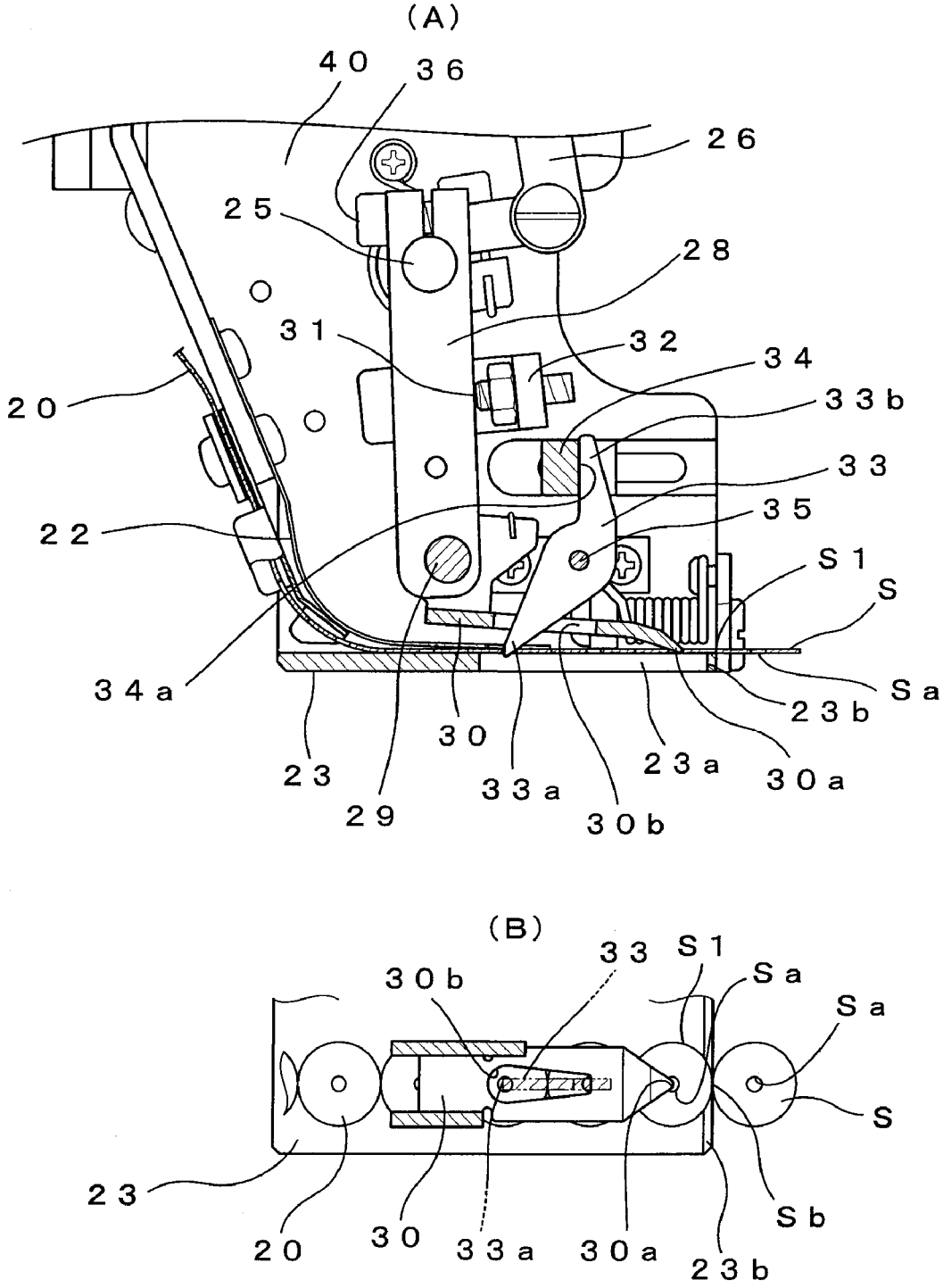

Lastly, with reference to FIGS. 9 and 10, a brief description will be given about a detailed construction of the sequin feeder apparatus employed in the instant embodiment, although such a construction of sequin feeder apparatus is known from Japanese Patent Application Laid-open Publication No. 2004-167097 (corresponding to U.S. Pat. No. 7,082,884) mentioned above. FIG. 9 is a perspective view of the left sequin feeder apparatus 3, (A) of FIG. 10 is a partly-sectional side view showing in an enlarged scale relevant sections of the sequin feeder apparatus 3, and (B) of FIG. 10 is a schematic plan view of the relevant sections of the sequin feeder apparatus. Portion of a continuous sequin strip 20, let out from a sequin supplying reel (not shown), is directed, through a gap between a guide 21 and a holding plate 22, onto a supporting plate 23, from which it is further delivered, via a sequin feed mechanism, toward a cutting position, i.e. toward a fixed cutter blade 23*b* and movable cutter blade 24. The supporting plate 23 has a slit 23*a* of a suitable width extending in a front-rear (Y) direction (see (A) of FIG. 10). Engaging claw 33*a* of a lock lever 33 provided in the sequin feed mechanism is allowed to enter the slit 23*a*.

Rotation of a motor 27 is transmitted, via a link mechanism 26, to a shaft 25 supported by a support plate 40. Pivot lever or arm 28 is fixed, by means of a screw 36, to the shaft 25, and a feed lever 30 having a hook portion 30*a* formed at its distal end is pivotably supported, via a shaft 29, on a free end portion of the pivot arm 28. Torsion spring (not shown) normally urging the feed lever 30 in a clockwise direction is provided on the shaft 29 so that the distal end side of the feed lever 30 is normally urged toward the supporting plate 23. By the clockwise urging of the feed lever 30, the pivot arm 28 is normally urged in a direction where it abuts against a stopper 31. The pivot arm 28 performs reciprocative pivotal movement (reciprocative stroke) via the link mechanism 26 with forward and reverse rotation of the motor 27 through a predetermined rotational angular range as one cycle. The stopper 31 is in the form of a threaded rod screwed to a bracket 32 that is in turn secured to the support plate 40, and the threaded rod can be locked by screwing up of a nut. The pivot arm 28 abuts against the rear end of the threaded rod. As will be later described, adjusting a projecting amount of the stopper 31 can adjust a start point of the pivot stroke of the pivot arm 28, i.e. a stopping position of the hook portion 30*a* formed at the distal end of the feed lever 30.

The lock lever 33 is provided over the feed lever 30, and the lock lever 33 has the engaging claw 33*a* at the tip of its one end and the stopper portion 33*b* at its other end. Intermediate portion of the lock lever 33 is pivotably supported, via a pin 35, by a support block 34 that is in turn fixed to the support plate 40. In FIG. 4, the support block 35 is shown with its front portion taken away to allow the lock lever 33 to be visible more easily. The engaging claw 33*a* of the lock lever 33 extends through a through-hole 30*b* formed in the feed lever 30, and a torsion spring (not shown) is provided on the pin 35 provided on the support block 34. The lock lever 33 is normally biased, by that torsion spring, against the support block 34 in the counterclockwise direction of the figure and the stopper portion 33*b* of the thus-biased lock lever 33 abuts against a stopper portion 34*a* of the support block 34, so that the lock lever 33 in its free state is held in a posture or position where the end of the engaging claw 33*a* confronts the slit 23*a* of the supporting plate 23. The engaging claw 33*a* of the lock lever 33, held in this position, engages a sewing hole Sa of a predetermined one of the sequins S of the continuous sequin strip 20 led onto the supporting plate 23, to thereby immovably lock the continuous sequin strip 20 during sewing (cutting) operation.

Now, a description will be given about an example manner in which sequins are fed in the sewing operation. The sequin S located at the leading end of the continuous sequin strip 20 is severed from the continuous sequin strip 20 as it is sewn onto an embroidering workpiece. Then, before the next sewing operation cycle is started, the pivot arm 28 is caused to pivot in the clockwise direction of FIG. 10, in response to the forward rotation of the motor 27, so that the reciprocative pivotal movement is started. Thus, the hook portion 30*a* of the feed lever 30 gets out of the sewing hole of the sequin S1 and moves toward the succeeding sequin while pushing upward the lock lever 33. The reciprocative pivotal movement ends when the motor 27 has rotated through the predetermined angular range, at which time the hook portion 30*a* of the feed lever 30 is located slightly ahead (in FIG. 10, leftward) of the sewing hole of the succeeding sequin (i.e., sequin next to the sequin S1)(namely, the hook portion 30*a* has not yet entered in the sewing hole of the succeeding sequin) and the lock lever 33 too is still located over the succeeding sequin. Then, the motor 27 is rotated in the reverse direction so that the pivot arm 29 is caused to pivot in the counterclockwise direction of FIG. 10 and thus the return stroke is started, in response to which the feed lever 30 starts moving toward the fixed cutter blade 23*b* (rightward in FIG. 10). Then, the hook portion 30*a* of the feed lever engages the sewing hole Sa of the succeeding sequin (i.e., sequin next to the sequin S1), and the continuous sequin strip 20 is fed toward the fixed cutter blade 23*b* (rightward in FIG. 10) by the hook portion 30*a* engaging the sewing hole Sa of the succeeding sequin. During that time, the engaging claw 33 of the lock lever 33 resiliently contacts the upper surface of the continuous sequin strip 20 and slides on and relative to the upper surfaces of the sequins. At the end of the return stroke, the leading sequin S1 reaches a predetermined cutting position (i.e., predetermined sewing position) in the same manner as the leading sequin S shown in FIG. 10. Then, the engaging claw 33*a* of the lock lever 33 engages the sewing hole of a predetermined sequin of the continuous sequin strip 20.

In variable sequin feed amount (feed pitch) setting, not only a desired feed amount is set, through human operator's operation on the operation panel box 10, for each of the sequin feeder apparatus 2 and 3 in each predetermined group, but also mechanical adjustment of the pivot lever or arm 28, feed lever 30 and lock lever 33 is performed in each of the sequin feeder apparatus 2 and 3.

Such mechanical adjustment will now be described. First, the screw 36 fastening the pivot arm 28 is loosened so that the pivot arm 28 can be readily turned manually relative to the pivot shaft 25. Further, the nut of the stopper 31 is loosened and the leading sequin S of the continuous sequin strip 20 is caused to project forward beyond the fixed cutter blade 23*b* as shown in (B) of FIG. 10 so that a connecting portion Sb of the leading sequin S is positioned in vertical alignment with the fixed cutter blade 23*b*, after which the center of the sewing hole Sa of the leading sequin S is caused to vertically align with the center of a corresponding sewing needle (not shown). This state represents a feed-out completion state of the feeder apparatus when a sequin feed-out cycle corresponding to one pitch has been completed. In this "feed-out completion state", the pivot arm 28 and feed lever 30 are moved manually to cause the hook portion 30*a* of the feed lever 30 to engage the sewing hole Sa of the second sequin S1 from the leading end of the strip 20; namely, the pivot arm 28 and feed lever 30 are adjusted to the "feed-out completion state" corresponding to the one-pitch feed-out of the sequin. In order to fix the pivot arm 28 and feed lever 30 in their respective positions adjusted to the "feed-out completion state", the nut of the stopper 31 is again tightened to lock the stopper 31 and the screw 36 is tightened to fix the pivot arm 28 relative to the pivot shaft 25. Assuming that each sequin S of the continuous sequin strip 20 has a 6 mm diameter and has the sewing hole Sa formed in its center, a distance between the fixed cutter blade 23*b* and the sewing hole Sa of the second sequin S1 from the leading end of the continuous sequin strip 20 measures about 3 mm in the "feed-out completion state". Here, the position, in the front-rear direction, of the support plate 40 including the supporting plate 23 or the position, in the front-rear direction, of at least the supporting plate 23 (and hence the position of the fixed cutter blade 23*b*) is subjected to fine adjustment, in accordance with the size of the sequin S of the continuous sequin strip 20, in such manner that the sewing hole Sa of the leading sequin S is positioned in alignment with the vertical moving trajectory of the sewing needle (not shown); however, illustration of a mechanism for the fine adjustment is omitted.

Next, with the pivot arm 28, feed lever 30 and continuous sequin strip 20 on the supporting plate 23 kept in the "feed-out completion state" as noted above, the support block 34 of the lock lever 33 is unlocked, and then the lock lever 33 is adjusted. Here, the position, in the front-rear direction, of the support block 34 is adjusted manually to adjust the inclination of the lock lever 33 so that the engaging claw 33*a* of the lock lever 33 engages the sewing hole of a predetermined sequin S (several sequins, e.g. two sequins, after the sequin S1 engaged by the engaging claw 33*a* of the lock lever 33) with the stopper portion 33*b* at the upper end of the lock lever 33 abutted against the stopper portion 34*a* of the support block 34. Then, the support block 34 is again locked with the lock lever 33 positionally adjusted in the aforementioned manner.

The preceding paragraphs have described the sequin feed amount setting per group responsive to operation on the operation panel box 10. The sequin feed amount thus set per group in the above-described manner corresponds to the rotational angular range of the motor 27 for performing the one-pitch feeding drive. Namely, the rotational angular range of the motor 27 (i.e., the end of the advance stroke of the reciprocative pivotal movement of the feed lever 30 performing the one-pitch feeding operation=the start of the return stroke of the feed lever 30) is set in accordance with the set sequin feed amount. Initial position of the motor 27 agrees with the start of the advance stroke of the reciprocative pivotal movement of the feed lever 30 (=the end of the return stroke of the feed lever 30), and it is a position where the pivot lever or arm 28 is stopped by the stopper 31. During the return stroke, the energization of the motor (e.g., pulse motor) 27 is terminated before the motor 27 returns to the initial position so that the pivot arm 28 abuts against the stopper 31 by the resilient restoring force of the spring. Thus, the motor 27 can be restored to the initial position without fail even when it has lost synchronization due to some cause. Thus, during the sewing operation, the driving of the motor 27 is controlled in accordance with the sequin feed amount set per group, and the feed lever 30 performs the reciprocative stroke corresponding to the set feed amount.

What is claimed is:

1. A sewing machine comprising:

a plurality of machine heads;

at least one sequin feeder apparatus provided for each of said machine heads;

grouping means for grouping a desired number of machine heads of said plurality of machine heads into a group, in order to sew a sequin-contained embroidery pattern;

setting means for variably setting a sequin feed pitch independently for each of said sequin feeder apparatus of the machine heads grouped into the group, wherein, in the group, a selected one of said sequin feeder apparatus performs a sequin sewing operation, the selected sequin feeder apparatus feeding out a sequin toward a needle drop location in accordance with the feed pitch set for the selected sequin feeder apparatus via said setting means, each of said machine heads is a multi-needle head arranged to selectively set any one of a plurality of needle bars at the needle drop location to perform the sewing operation, and said sequin feeder apparatus is provided in correspondence with a position of at least one of the needle bars in the multi-needle head, said sawing machine further comprising a number-of-rotation setting means for setting a number of machine rotations for use when the needle bar corresponding to said sequin feeder apparatus has been selected in the multi-needle head, independently of a number of machine rotations for use when other of the needle bars has been selected in the multi-needle head.

2. A sewing machine as claimed in claim 1 where, when the needle bar to be selected in the multi-needle head is switched to the needle bar corresponding to said sequin feeder apparatus during the sewing operation, a number of rotations of a main machine shaft is switched, without operation of said sewing machine being stopped, to the number of machine rotations set, via said setting means, for use when the needle bar corresponding to said sequin feeder apparatus has been selected.

3. A sewing machine comprising:

a plurality of machine heads;

at least one sequin feeder apparatus provided for each of said machine heads;

grouping means for grouping a desired number of machine heads of said plurality of machine heads into a group, in order to sew a sequin-contained embroidery pattern; and setting means for variably setting a sequin feed pitch independently for each of said sequin feeder apparatus of the machine heads grouped into the group, wherein, in the group, a selected one of said sequin feeder apparatus performs a sequin sewing operation, the selected sequin feeder apparatus feeding out a sequin toward a needle drop location in accordance with the feed pitch set for the selected sequin feeder apparatus via said setting means, said grouping means groups said plurality of machine heads into a plurality of groups, and said setting means variably sets a sequin feed pitch independently for each of said sequin feed apparatus of the machine heads grouped into one of the groups, the sequin feed pitches having been set for said sequin feed apparatus in the one group being shared between all of the groups.

4. A method for setting a sequin feed amount for a sewing machine including a plurality of machine heads and at least one sequin feeder apparatus provided for each of the machine heads, said method comprising:

a step of grouping a desired number of machine heads of the plurality of machine heads into a group, in order to sew a sequin-contained embroidery pattern; and a step of variably setting a sequin feed pitch independently for each of the sequin feeder apparatus of the machine heads grouped into the group, wherein, in the group, a selected one of the sequin feeder apparatus performs a sequin sewing operation, the selected sequin feeder apparatus feeding out a sequin toward a needle drop location in accordance with the feed pitch set for the selected sequin feeder apparatus via said step of variably setting, each of said machine heads is a multi-needle head arranged to selectively set any one of a plurality of needle bars at the needle drop location to perform the sewing operation, and said sequin feeder apparatus is provided in correspondence with a position of at least one of the needle bars in the multi-needle head, said method further comprising a step of setting a number of machine rotations for use when the needle bar corresponding to said sequin feeder apparatus has been selected in the multi-needle head, independently of a number of machine rotations for use when other of the needle bars has been selected in the multi-needle head.

5. A machine readable medium encoded with a program for causing a computer to perform a procedure for setting a sequin feed amount for a sewing machine including a plurality of machine heads and at least one sequin feeder apparatus provided for each of the machine heads, said procedure comprising:

a step of grouping a desired number of machine heads of the plurality of machine heads into a group, in order to sew a sequin-contained embroidery pattern; and a step of variably setting a sequin feed pitch independently for each of the sequin feeder apparatus of the machine heads grouped into the group, wherein, in the group, a selected one of the sequin feeder apparatus performs a sequin sewing operation, the selected sequin feeder apparatus feeding out a sequin toward a needle drop location in accordance with the feed pitch set for the selected sequin feeder apparatus via said step of variably setting, each of said machine heads is a multi-needle head arranged to selectively set any one of a plurality of needle bars at the needle drop location to perform the sewing operation, and said sequin feeder apparatus is provided in correspondence with a position of at least one of the needle bars in the multi-needle head, said method further comprising a step of setting a number of machine rotations for use when the needle bar corresponding to said sequin feeder apparatus has been selected in the multi-needle head, independently of a number of machine rotations for use when other of the needle bars has been selected in the multi-needle head.

6. A method for setting a sequin feed amount for a sewing machine including a plurality of machine heads and at least one sequin feeder apparatus provided for each of the machine heads, said method comprising:

a step of grouping a desired number of machine heads of the plurality of machine heads into a group, in order to sew a sequin-contained embroidery pattern; and a step of variably setting a sequin feed pitch independently for each of the sequin feeder apparatus of the machine heads grouped into the group, wherein, in the group, a selected one of the sequin feeder apparatus performs a sequin sewing operation, the selected sequin feeder apparatus feeding out a sequin toward a needle drop location in accordance with the feed pitch set for the selected sequin feeder apparatus via said step of variably setting, said grouping means groups said plurality of machine heads into a plurality of groups, and said setting means variably sets a sequin feed pitch independently for each of said sequin feed apparatus of the machine heads grouped into one of the groups, the sequin feed pitches having been set for said sequin feed apparatus in the one group being shared between all of the groups.

7. A machine readable medium encoded with a program for causing a computer to perform a procedure for setting a sequin feed amount for a sewing machine including a plurality of machine heads and at least one sequin feeder apparatus provided for each of the machine heads, said procedure comprising:

a step of grouping a desired number of machine heads of the plurality of machine heads into a group, in order to sew a sequin-contained embroidery pattern; and a step of variably setting a sequin feed pitch independently for each of the sequin feeder apparatus of the machine heads grouped into the group, wherein, in the group, a selected one of the sequin feeder apparatus performs a sequin sewing operation, the selected sequin feeder apparatus feeding out a sequin toward a needle drop location in accordance with the feed pitch set for the selected sequin feeder apparatus via said step of variably setting, said grouping means groups said plurality of machine heads into a plurality of groups, and said setting means variably sets a sequin feed pitch independently for each of said sequin feed apparatus of the machine heads grouped into one of the groups, the sequin feed pitches having been set for said sequin feed apparatus in the one group being shared between all of the groups.

* * * * *